US005482157A

United States Patent [19]

Kim

[11] Patent Number: 5,482,157

[45] Date of Patent: Jan. 9, 1996

[54] CIGARETTE WRAPPER WITH MATCH CHAMBER

[76] Inventor: Kee Y. Kim, 498 Su Ryun Dong, Su Ryun Myun, Sung Ju Gun, Kyung Sang Buk Do, Rep. of Korea

[21] Appl. No.: 120,088

[22] Filed: Sep. 13, 1993

[30] Foreign Application Priority Data

Mar. 30, 1993 [KR] Rep. of Korea ..... 93-5200

[51] Int. Cl.[6] ..... A24F 15/10; B65D 85/10

[52] U.S. Cl. ..... 206/92; 206/86

[58] Field of Search ..... 206/85, 86, 90, 206/92, 93, 98, 123

[56] References Cited

U.S. PATENT DOCUMENTS

| | | | |
|---|---|---|---|
| 528,763 | 11/1894 | Craw | 206/93 |
| 820,860 | 5/1906 | DoGall | 206/92 |
| 1,023,054 | 4/1912 | Walsh | 206/92 |
| 1,865,063 | 6/1932 | Thomas | 206/92 |
| 1,898,227 | 2/1933 | Thomas | 206/92 |
| 2,506,832 | 5/1950 | Henion | 206/92 |
| 2,811,247 | 10/1957 | Stevenson | 206/86 X |
| 3,915,295 | 10/1975 | Morrison | 206/86 X |
| 4,962,850 | 10/1990 | Monto | 206/90 |
| 5,096,057 | 3/1992 | Yoo | 206/90 |

FOREIGN PATENT DOCUMENTS

| | | | |
|---|---|---|---|
| 553591 | 8/1993 | European Pat. Off. | 206/98 |
| 304371 | 1/1933 | Italy | 206/123 |
| 11151 | 5/1905 | United Kingdom | 206/92 |

*Primary Examiner*—Bryon P. Gehman

*Attorney, Agent, or Firm*—Laff, Whitesel, Conte & Saret Ltd.

[57] ABSTRACT

A cigarette wrapper has two chambers, one for cigarettes and the other for matches. The other chamber includes a match case at either the upper or lower part of cigarette case. The match case is made of plastic material, and has a cover and an outlet at one end. In a preferred embodiment, a guide indentation at the one side of the match case has a match dispensing outlet and a shaft hole, for receiving a pivoted door inserted to the shaft hole for covering or uncovering the outlet. An L-shaped push member has one arm connected with the match case having a pin at the end of its other arm for rotating the pivoted door. In another embodiment, the push member has a hole in the other arm for covering or uncovering the outlet responsive to a sliding of the other arm.

5 Claims, 7 Drawing Sheets

CIGARETTE WRAPPER WITH MATCH CHAMBER

BACKGROUND OF THE INVENTION

1. Field of the Invention

The present invention relates to a cigarette wrapper case newly designed to provide a chamber for holding matches included in the cigarette wrapper case for the convenience of a smoker.

2. Description of the Prior Art

Generally, a smoker uses a match or a lighter when lighting a cigarette. But it is very troublesome to always have to bring a separate match or a lighter for lighting up whenever one smokes. Concerning these inconveniences a new cigarette case was invented earlier. This prior art includes paper matches attached at one outer side of a cigarette case. A smoker tears off a matchstick from the attached paper matches, but it has the same problems as with a usual match.

Accordingly, it is an object of the present invention to provide a cigarette case having therein a match case which may be used easily.

Another object of the present invention is to provide a cigarette wrapper case having a button for opening an outlet of a match case to dispense a matchstick.

Other objects and a further scope of the applicability of the present invention will become apparent from the detailed description given hereinafter. It should be understood, however, that the detailed description and specific examples while indicating preferred embodiments of the invention are given by way of illustration only. Various changes and modifications may be made within the spirit and scope of the invention, as will become apparent to those skilled in the art. Hence, the specific embodiments and examples given herein, while indicating preferred embodiments of the invention, are given by way of illustration only. Since various changes and modifications may be made within the spirit and scope of the invention, the appended claims are to be construed to include all equivalent structures.

BRIEF DESCRIPTION OF THE DRAWING

The present invention will become more fully understood from the detailed description given hereinbelow and from the accompanying drawings wherein:

FIG. 21 is a side view schematically showing the use of this cigarette case to dispense a matchstick.

DESCRIPTION OF THE PREFERRED EMBODIMENT

Figure 1:
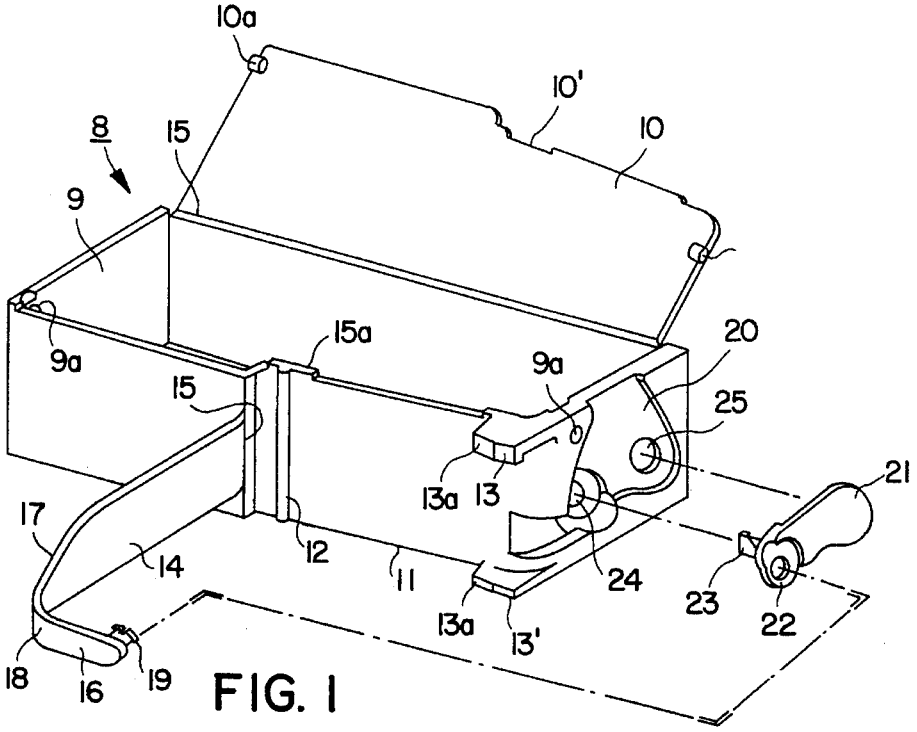
FIG. 1 is a partially exploded perspective view of the match case using a pivoted door to dispense matches according to the present invention.

A match case 8 is contained at the upper or lower part of cigarette wrapper case 1 and is made of plastic material. A chamber 4 may be defined by a fixed or movable partition 5, 6 within the cigarette wrapper case, cover 10 and an outlet 25 at the one end side, a guide indentation 20 at one side, a shaft hole 24, an indented part 11 having a transverse support pillar or line 12, and a movement limitational extrusion 13, 13' at opposite sides of the match case 8, an "L" shaped strap member 14 connected to the match case 8 near indented part 11, a pin 19 at the toe 16 of the "L", and a rotating or pivoted door member 21 having end 23 inserted into the shaft hole 24. The L-shaped member 14 has a pin 19 to be inserted into the connecting hole 22 of the rotating door member 21.

Figure 2:
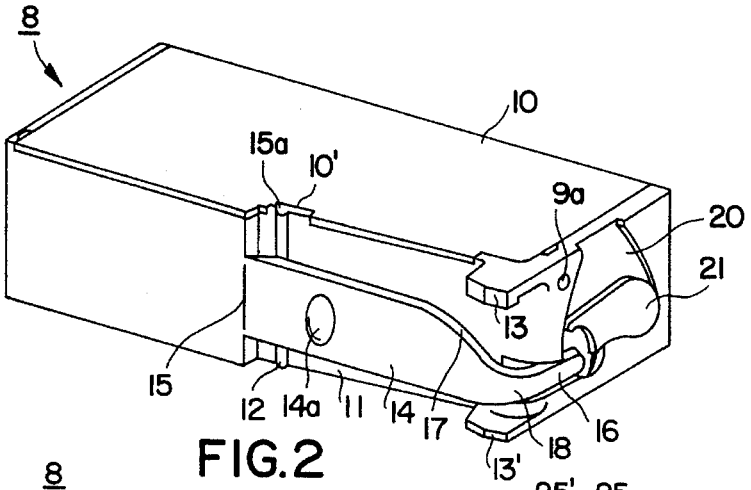
FIG. 2 is a perspective view of FIG. 1 of a match case according to the present invention.
Figure 4A:
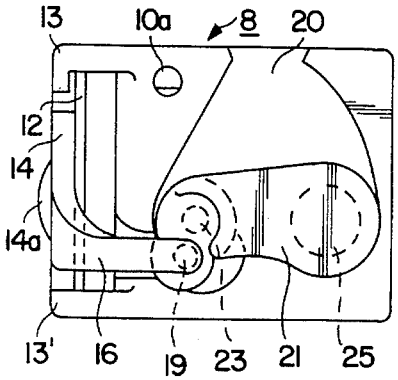
FIG. 4 is an end view of a match case for this invention, FIG. 4A showing a match case having a pivoted door for closing a match dispensing outlet, FIG. 4B showing it opened.
Figure 4B:
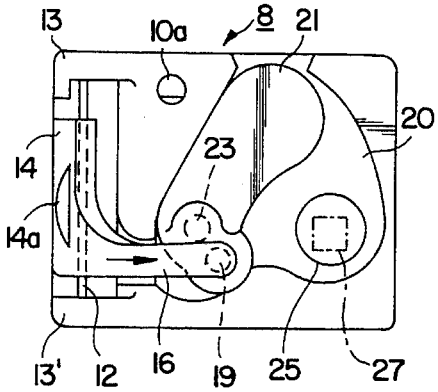

The push member 14 has a member 14*a* (FIG. 2) extruding inwardly from the push member for cooperating with a guidehole 7 (FIG. 5) of cigarette wrapper case 1 and for pushing the push member 14 in order to make the rotating door member 21 rotate to open the outlet 25 (FIGS. 4A and 4B).

Figure 5:
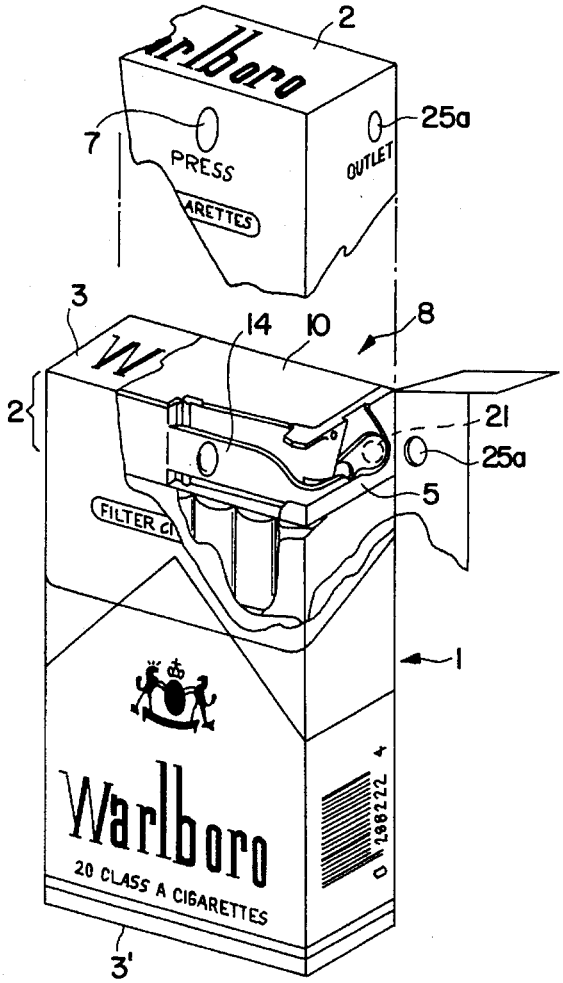
FIG. 5 is a partially broken away perspective view of a cigarette wrapper case with the match case.
Figure 6:
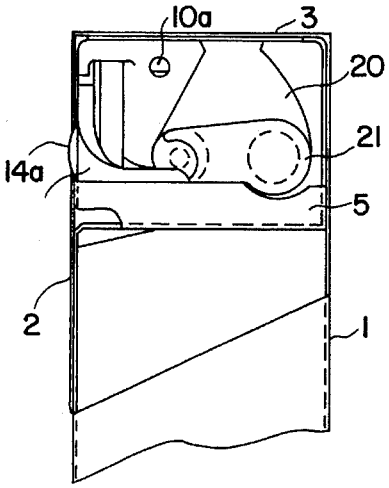
FIG. 6 is an enlarged side view of FIG. 5 according to the present invention.

This invention is very useful for a cigarette wrapper case having an upper lid 2 shown at FIG. 5, for example. The match case 8 comprises a small rectangular box made of plastic material and has a match containing chamber 4 (FIG. 1) divided from the cigarette chamber by a fixed or movable partition 5 or 6 (FIGS. 8, 9, 13), which may be glued to the inner face of cigarette wrapper case 1. An outlet 25*a* is prepared at the one end side of cigarette wrapper case 1.

The match case 8 comprises chamber 4 (FIG. 1) for containing matchsticks and preferably hinged cover 10. An indented side wall part 11 has a support pillar or line 12 and extruded limits 13, 13' is at opposite sides of match case 8, for positioning L-shaped push member 14, which is connected with match case 8. One arm of the L-shape is a swinging lever; the other arm of the L-shape controls the opening or closing of opening 25 for dispensing matches.

A guide indentation 20 at the outer end side of match case 8 has an outlet 25 and shaft hole 24 on its surface. A center pivot pin 23 provides for rotating door member 21. Pin 23 is inserted into the shaft hole 24 and then pin 19 on the operating arm of the L-shape is inserted in the connection hole 22 for rotating door member 21 between opened and closed positions respectively.

Outlet 25 must be opened in order to remove a match from match case 8. Outlet 25*a* is in the cigarette wrapper case 1 and is desirably smaller than and aligned with outlet 25 for the purpose of having a good design.

It is desirable to have a dome member 14*a* extended or extruded inwardly from push member 14 and cooperating with a guidehole 7 (FIG. 5) in cigarette wrapper case 1. In this design, the extended or extruded member 14*a* would preferably extend a little from the surface of cigarette wrapper case 1 in order to form a push button.

Figure 7:
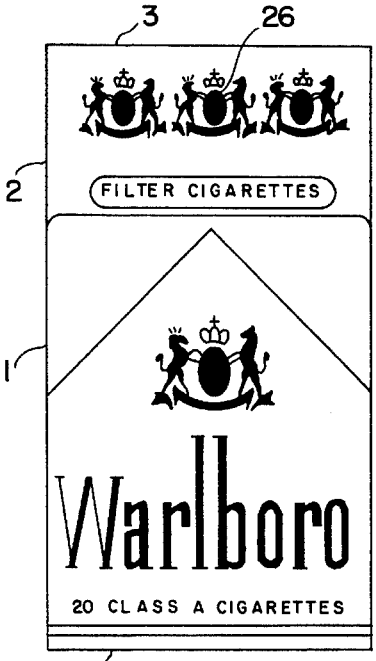
FIG. 7 is an explanational view of a strike-face of a cigarette wrapper case.
Figure 8:
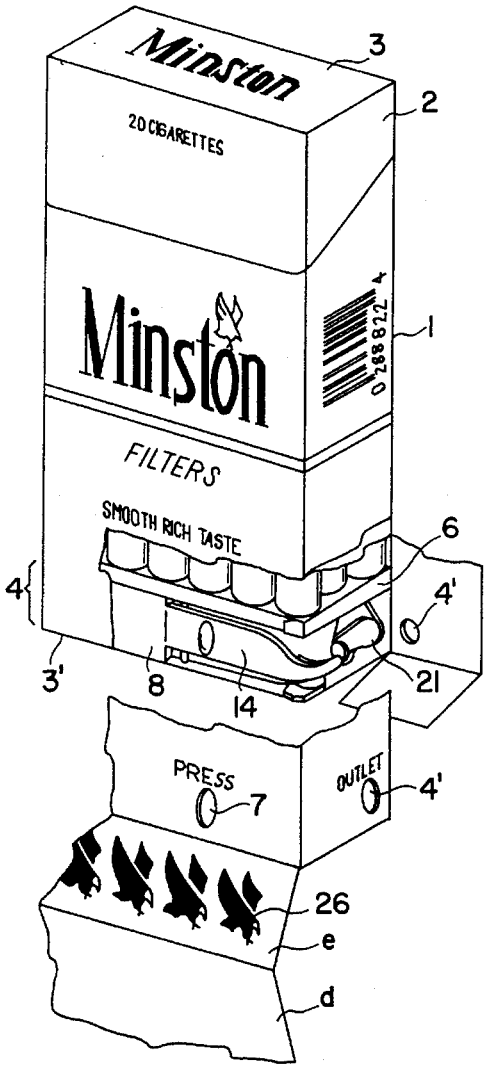
FIG. 8 is a partially-cut-away perspective view of a cigarette wrapper case including a match case at a lower part of cigarette case and showing a strike face on the bottom.
Figure 9:
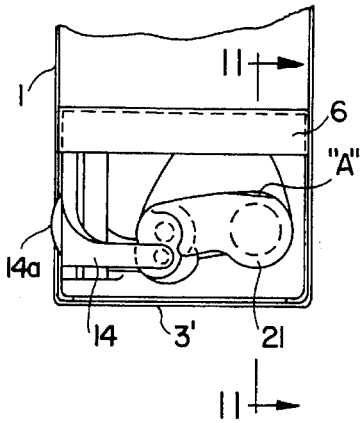
FIG. 9 is an enlarged view of part of FIG. 8.
Figure 10:
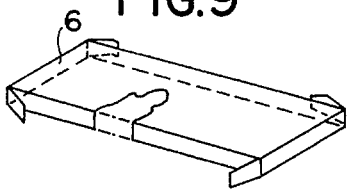
FIG. 10 is a perspective view of a separate partition forming one wall of FIG. 8 which separates the cigarette and match areas.

As shown in FIG. 7 and 8 the strike-face 26 is on the outer surface of cigarette wrapper case 1 and can have a certain graphic design such as the logo of the cigarette maker, a brandname, etc.

Figure 3A:
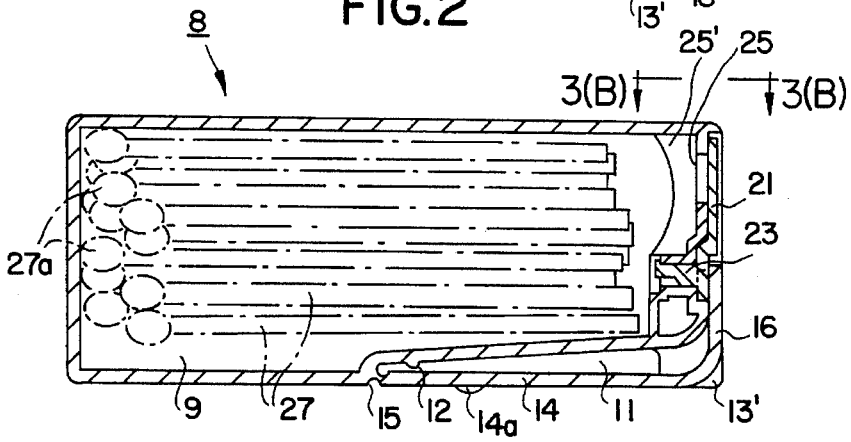
FIG. 3A is an elevational view in cross section of a match case according to this invention, FIG. 3B indicates a sectional view taken along line 3B—3B.
Figure 3B:
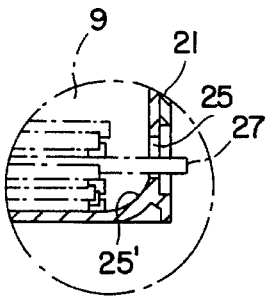

Other members of the match case 8 (FIG. 1), which may be made of the cardboard paper of the cigarette wrapper case, are a locking hole 9*a* (FIG. 1), a locking member 10*a* for holding LID 10 in a closed position, an inserting indent 10'. An inserting member 15*a* cooperates with inserting indent 10', to hold lid 10 in a closed position. The L-shaped arm 14 has a declined part 17. A matchstick 27 (FIG. 3) has an explosive match head 27*a*.

The expanded plan view of the cardboard blank (FIG. 12) of a cigarette wrapper case 1 has a fixed partition 5 and is made as a single unitary piece. Match case 8 is contained at the upper part of the cigarette wrapper case by a fixed partition 5.

Figure 12:
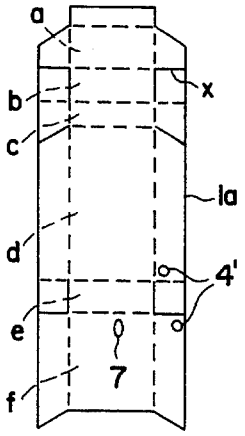
FIG. 12 is an expanded view of a blank for forming cigarette wrapper case with a match case unitarily connected thereto and defined in part by a fixed partition.
Figure 13:
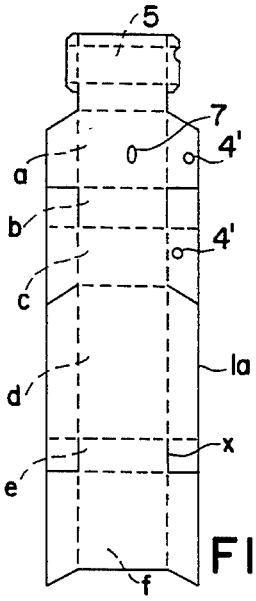
FIG. 13 is an expanded view of a blank for forming a cigarette wrapper case using a separate partition of FIG. 10 to form the match case.
Figure 14:
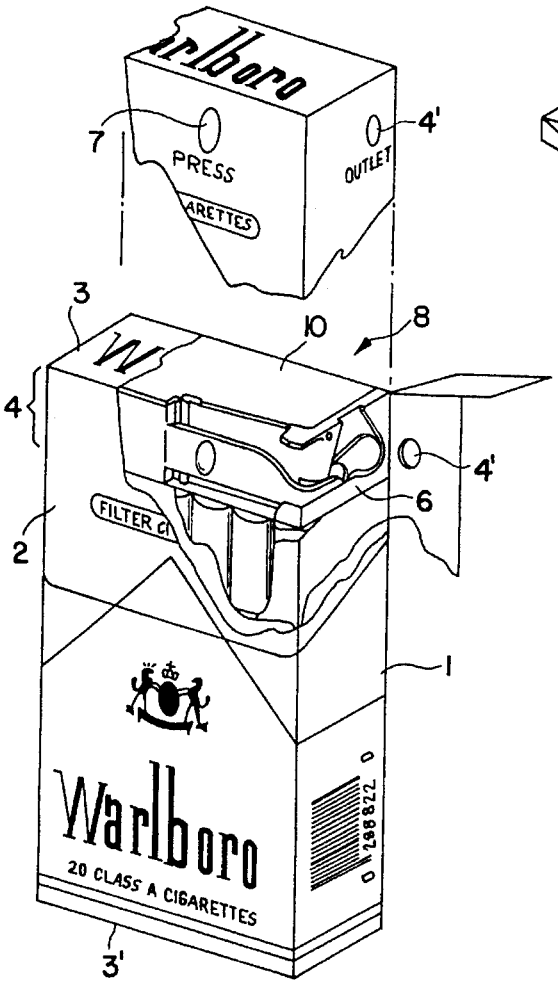
FIG. 14 is another perspective, partially exploded, view of a cigarette case containing a match case.
Figure 15:
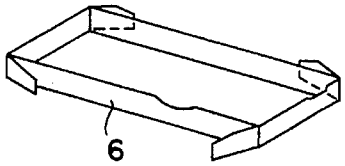
FIG. 15 is a perspective view of another movable partition of a cigarette wrapper case.
Figure 16:
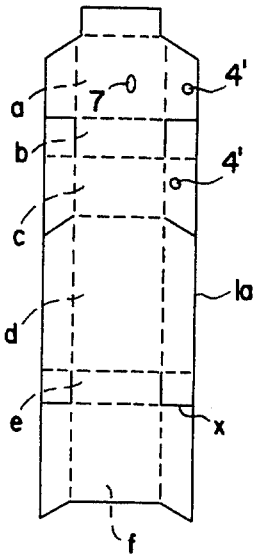
FIG. 16 is an expanded view of the blank for forming the cigarette case of FIG. 14.
Figure 17A:
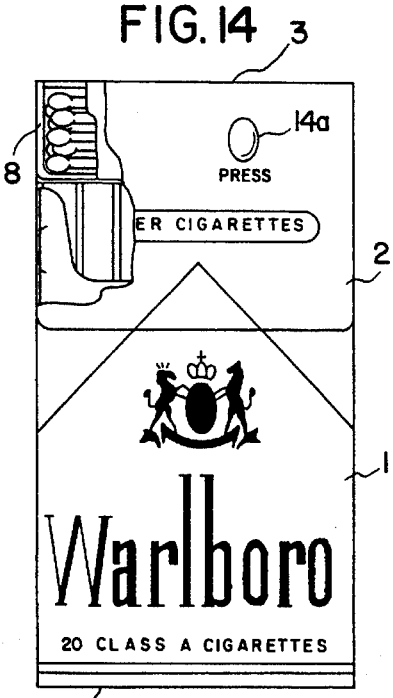
FIGS. 17A, 17B are a front view and a side view showing a push button operating the cigarette wrapper case having a match case at the upper part.
Figure 17B:
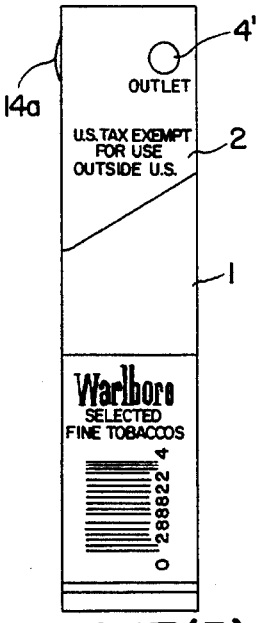
Figure 18A:
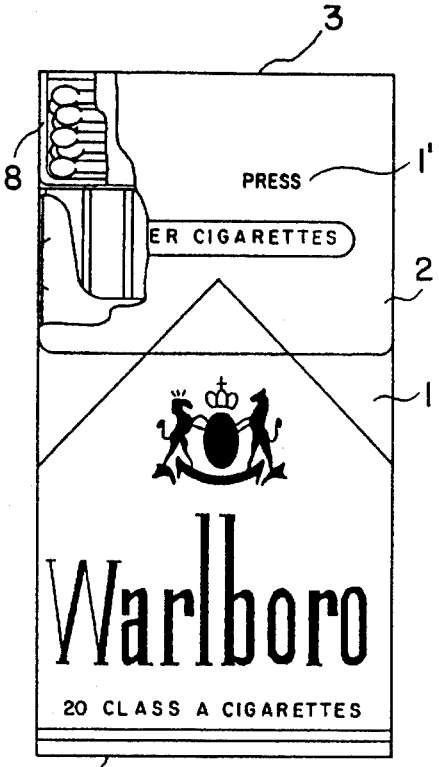
FIGS. 18A, 18B are a front view and side views of a cigarette case having no such push button.
Figure 18B:
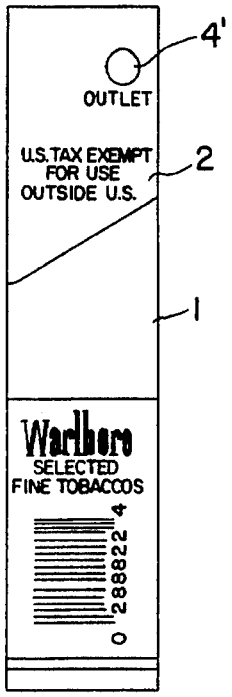
Figure 19A:
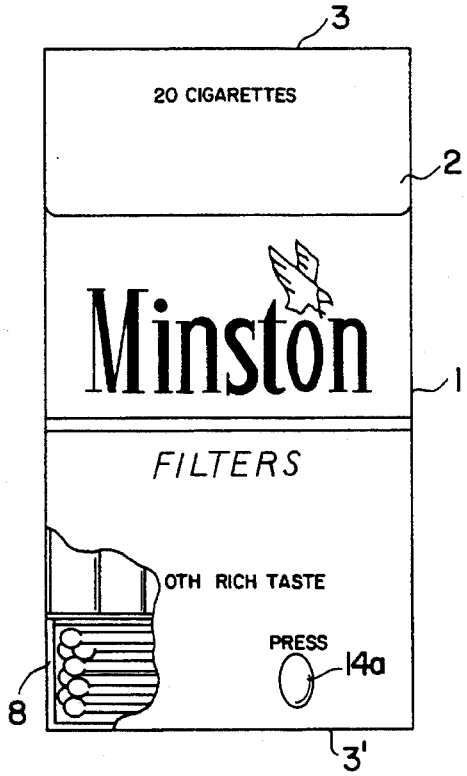
FIGS. 19A, 19B are a front view and a side view showing a push button for operating the cigarette wrapper case having a match case at the lower part of the pack.
Figure 19B:
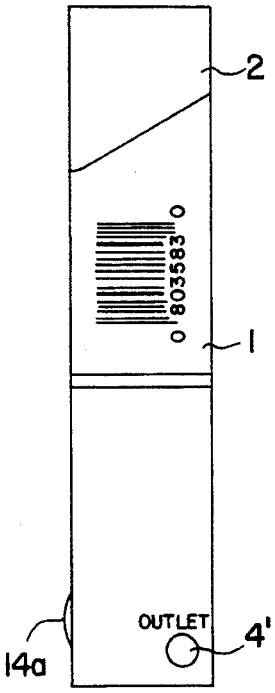
Figure 20A:
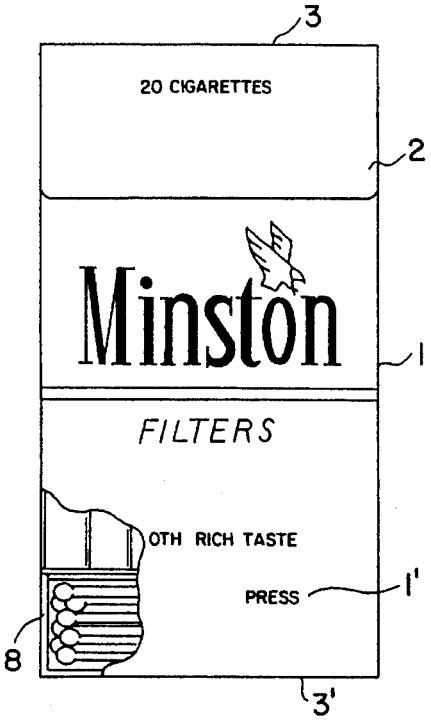
FIGS. 20A, 20B are a front view and a side view showing a cigarette wrapper case having a match case at the lower part respectively and having no such push button.
Figure 20B:
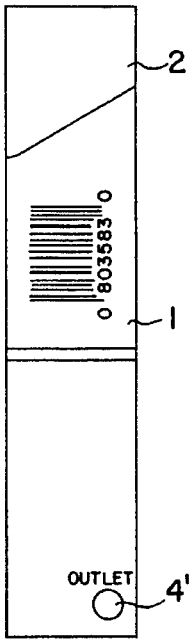

The formation of the cigarette wrapper case 1 according to this invention is accomplished by folding and gluing the blanks of FIGS. 12, 13. Pushing the push point 7 with a finger makes L-shaped push member 14 move inwardly and causes the pivoted or rotating door member 21 (FIG. 1) to rotate and to open the outlet 25. A smoker dispenses a match by inclining the match case 8, namely cigarette wrapper case 1, to a side and a match slides smoothly out of the outlets 25 and 25*a*. The diameters of outlets 25, 25*a* are a little more than the diameter of an explosive match head 27*a*.

After picking up a dispensed match, the smoker will remove his finger from the cigarette case, whereupon the memory of plastic member 14 makes the rotating door member 21 return to its original position, to close the outlets 25, 25*a*.

Figure 21A:
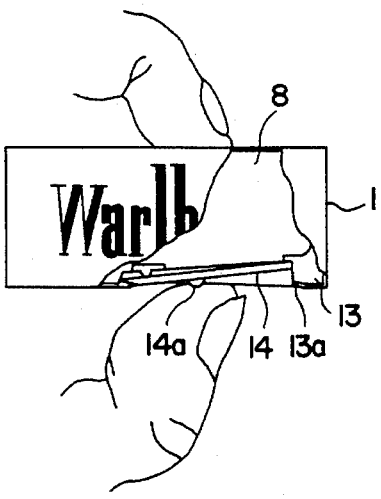
FIG. 21A is a view having a push button.
Figure 21B:
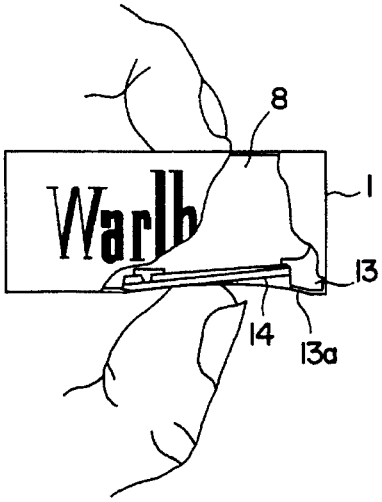
FIG. 21B is view having no such push button.
Figure 22:
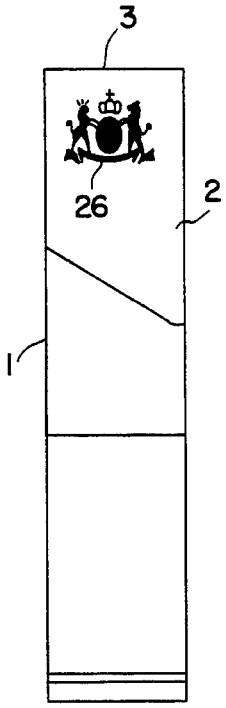
FIG. 22 is a view of strike-face on the side of a cigarette wrapper case according to this invention.

Limitational guide extrusions 13, 13' maintain the shape of cigarette case 1, and guarantees the free movement of push member 14. Declined parts of the limitational extrusion 13, 13' prevents the cigarette wrapper case from tearing when it is pushed by the smoker's finger, as shown in FIGS. 21A, 21B. A marking 7 on the surface of cigarette wrapper case 1 indicates the position of the finger when pushing arm 14.

Figure 11:
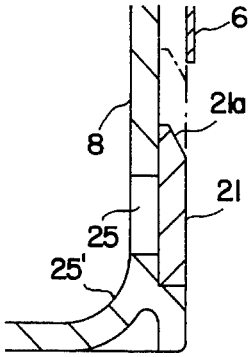
FIG. 11 is a cross-section view taken along line 11—11 of FIG. 9.

As shown in FIG. 11, when match case 8 is contained at the lower part of cigarette wrapper case 1, an inclined edge 21*a* is formed on pivoted or rotating door member 21 to avoid an interference with a separate partition 6.

The members of the match case are made of a thin plastic, to be operated easily. The height of the match containing chamber 4 is suitable for twenty to twenty-two or so matches, considering the diameter of the explosive head 27. It is desirable to have as few matchsticks as possible in order to minimize the height of chamber 4. To prevent the pushing of support pillar or line 12 (FIG. 1) inwardly, an extended part 15*a* is prepared and inserted into connecting indent 10' in the cover 10.

End part 17 of L-shaped push member 14 is narrowed to prevent an interference with pivoted or rotating door member 21 and to spread the concentrated stress for maintaining the elasticity of the plastic memory.

Figure 23A:
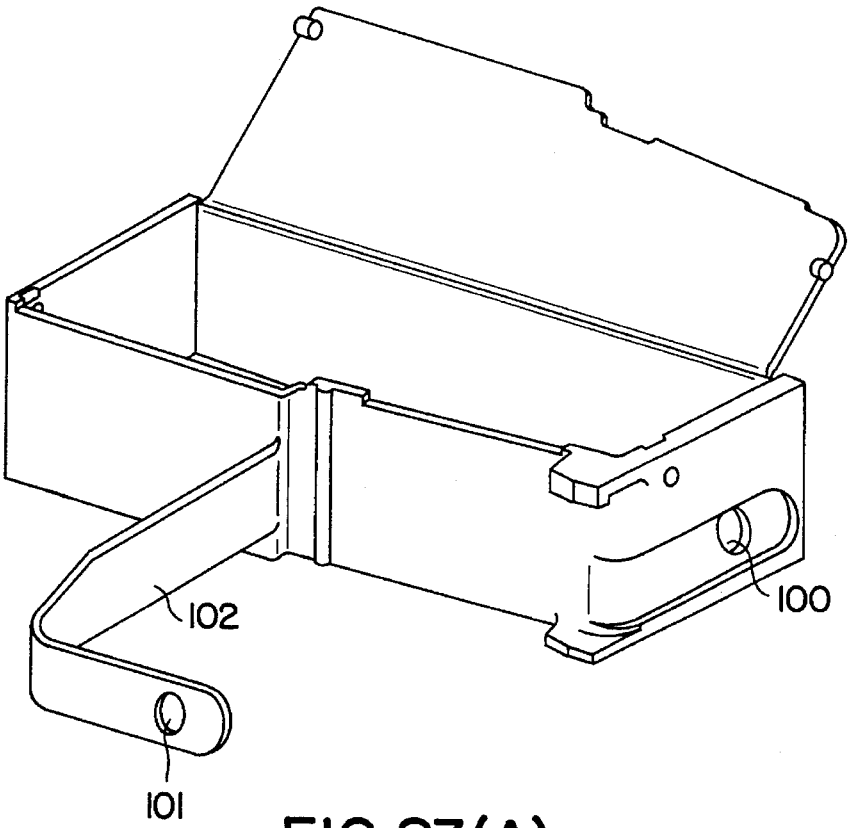
FIGS. 23A, 23B are perspective views of another embodiment of a match case using a sliding door to dispense matches.
Figure 23B:
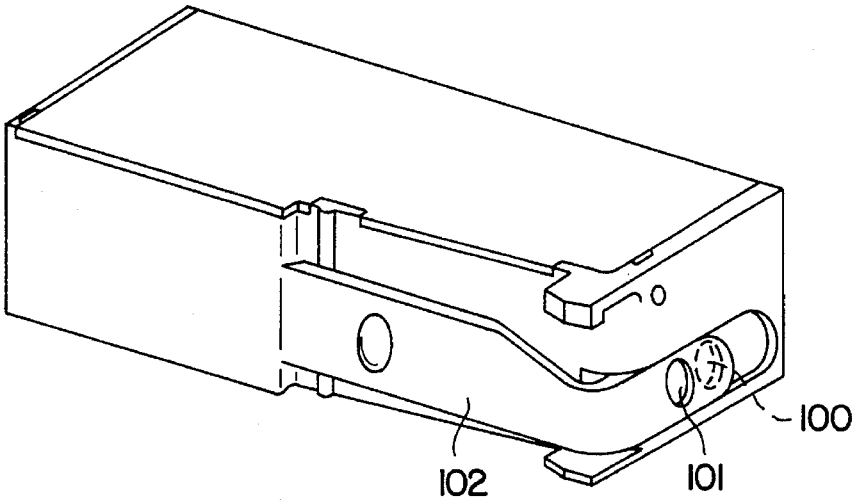

FIG. 23A, 23B are perspective views of another embodiment. Normally, the member 102 is positioned with hole 101 displaced from hole 100, so that the solid end on an arm of L-shaped member 102 covers the match dispensing hole 100. In this embodiment, the two holes 100, 101 are brought into registry by pushing the long arm of the L-shaped pushing member 102.

It will be obvious that the same invention may be varied in many ways. Such variations are not to be regarded as a departure from the spirit and scope of the invention. Therefore all such modifications and equivalent structures as would be obvious to one skilled in the art are intended to be included in the scope of the following claims.

What is claimed is:

1. A cigarette wrapper having two chambers, one of said chambers receiving cigarettes, the other of said chambers receiving matches, a plastic insert fitting in the match chamber, an opening in the plastic insert for dispensing matches from said other chamber, a door over said opening, the door having a pivot means that allows the door to swing between positions which open and close said opening, a push member comprising part of the insert and mounted to move said door to open and close said opening, said push member being an L-shaped member attached at one end of the L shape to the insert, the other end of the L shape being coupled to the door so as to swing said door between said positions, the plastic of said insert having a memory which, with the plastic L-shaped member in its normal position, urges said L-shaped member to position said door to cover and close said opening, said L-shaped member controlling movement of said door to uncover and open said opening when said L-shaped member is pushed to an off-normal position.

2. The case of claim 1 wherein said match chamber is defined by a partition in said cigarette wrapper.

3. The cigarette case of claim 1 wherein said match case further comprises:

at least a plastic end wall having an indented region with said opening therein, and a shaft hole formed therein, and said door being a cover plate mounted in said shaft hole and operated by said L-shaped member to move within said indented region and between said open and closed positions, said cover plate moving under the urging of said L-shaped member to open and close said opening.

4. The case of claim 3 wherein said push member has a pin at one end of said L-shaped member and said pin is connected with a hole in the said cover plate mounted in said indented region to operate said cover plate.

5. The case of claim 1 wherein an end wall of paid insert has an associated support line and at least one limitational extrusion in at least one side of the match chamber for bracing said wall and for guiding and directing said L-shaped push member.

* * * * *